US005274385A

United States Patent [19]

Riza

[11] Patent Number: 5,274,385

[45] Date of Patent: Dec. 28, 1993

[54] OPTICAL TIME DELAY UNITS FOR PHASED ARRAY ANTENNAS

[75] Inventor: Nabeel A. Riza, Clifton Park, N.Y.

[73] Assignee: General Electric Company, Syracuse, N.Y.

[21] Appl. No.: 900,877

[22] Filed: Jun. 18, 1992

[51] Int. Cl.[5] ..... H01Q 3/22; H01T 5/16

[52] U.S. Cl. ..... 342/375; 250/227.12; 342/368

[58] Field of Search ..... 342/375, 368; 250/227.12

[56] References Cited

U.S. PATENT DOCUMENTS

| | | | |
|---|---|---|---|
| 4,028,702 | 6/1977 | Levine | 342/374 |
| 4,813,766 | 3/1989 | Keene | 350/337 |
| 5,117,239 | 5/1992 | Riza | 342/375 |
| 5,144,321 | 9/1992 | Biet | 342/375 |
| 5,187,487 | 2/1993 | Riza | 342/372 |
| 5,191,339 | 3/1993 | Riza | 342/372 |

OTHER PUBLICATIONS

U.S. patent application Ser. No. 07/826,501.

*Primary Examiner*—Gregory C. Issing

*Attorney, Agent, or Firm*—Stephen A. Young; Paul Checkovich

[57] ABSTRACT

A phased array antenna system having an optical signal processing system includes a number of optical time delay units to generate differentially time-delayed optical signals. Each optical time delay unit is configured to generate a time delay through the use of either an optical fiber or free-space optical propagation delay assembly. Differentially time delayed optical signals are generated by controlling, with a spatial light modulator, the polarization of each light beam entering each time delay unit so that each respective light beam is deflected along either a direct path or a delay path dependent on its linear polarization. Each time delay unit includes an imaging system having a selected imaging ratio, with spherical lenses disposed in the delayed and direct light paths of the unit to provide imaging between the spatial light modulator planes. High extinction ratio polarizers are positioned in each of the delayed and direct paths. Spatial filters are further disposed in each spherical lens pair.

43 Claims, 4 Drawing Sheets

OPTICAL TIME DELAY UNITS FOR PHASED ARRAY ANTENNAS

BACKGROUND OF THE INVENTION

This invention relates generally to optical signal processing systems and more particularly to beamforming controls for phased array antennas in radar systems.

Phased array antenna systems employ a plurality of individual antenna elements or subarrays of antenna elements that are separately excited to cumulatively produce a transmitted electromagnetic wave that is highly directional. The radiated energy from each of the individual antenna elements or subarrays is of a different phase, respectively, so that an equiphase beamfront, or the cumulative wavefront of electromagnetic energy radiating from all of the antenna elements in the array, travels in a selected direction. The difference in phase or timing between the antenna activating signals determines the direction in which the cumulative beam from all of the individual antenna elements is transmitted. Analysis of the phases of return beams of electromagnetic energy detected by the individual antennas in the array similarly allows determination of the direction from which a return beam arrives.

Beamforming, or the adjustment of the relative phase of the actuating signals for the individual antenna elements (or subarrays of antennas) can be accomplished by electronically shifting the phases of the actuating signals or by introducing a time delay in the different actuating signals that sequentially excite the antenna elements in order to generate the desired direction of beam transmission from the antenna.

Optical control systems are advantageously used to create selected time delays in actuating signals for phased array antenna systems. Such optically-generated time delays are not frequency dependent and thus can be readily applied to broadband phased array antenna systems. For example, optical signals can be processed to establish the selected time delays between individual signals to cause the desired sequential actuation of the transmitting antenna elements, and the optical signals can then be converted to electrical signals, such as by a high speed photodetector array.

Several architectures for optical time delay units have been proposed. For example, an optical beam forming system for a phased array antenna is disclosed in U.S. Pat. No. 5,117,239 of N. Riza entitled "Reversible Time Delay Beamforming Optical Architecture for Phased Array Antennas, " which is assigned to the assignee of the present invention and incorporated herein by reference. These architectures generally depend on the use of linearly polarized light so that light beams of a predetermined polarization are directed through particular paths in the architecture to generate the differential time delay between a delayed and an undelayed signal. Thus, controlling the polarization of a light beam entering the architecture also determines the path that the light beam follows, and the path determines the delay imparted to the light beam.

The optical control system disclosed in the above referenced patent includes a transmit/receive phased array beamformer for generating true-time-delays using optical free-space delay lines and two dimensional liquid crystal spatial light modulators for implementing the optical switching. Unlike conventional optical switching techniques, the liquid crystal-based optical switching elements can provide low insertion loss and low crosstalk level switching with relatively easily fabricated and low cost liquid crystals.

In these polarization based systems using arrays of nematic liquid crystals (NLCs) and polarizing beam splitters to generate the time delay used in controlling the antenna, several factors can cause system performance to be degraded. For example, it is important that the respective light beams be directed through predetermined pixels in each NLC array in the optical architecture so that the polarization of the light beam as it enters each optical delay unit is of the desired orientation in order for the light beam to be directed along the desired path in each optical delay unit. As each light beam must pass through one predetermined liquid crystal (or pixel) in each sequential NLC array, any beam spreading due to free space propagation can result in significant optical losses (or attenuation of the optical signal) and high inter-channel crosstalk (in which the individual light beams spread out so that the light enters other than the desired pixel in each array), both of which reduce the signal to noise ratio in the system. For the same reasons, it is also important that the polarization of each light beam be uniform as it passes through each stage of the optical processing chain.

It is accordingly an object of this invention to provide an optical time delay unit that reduces optical beam spreading in light beams passing through the unit.

It is another object of the present invention to provide an optical time delay unit that maintains a high polarization uniformity in light beams processed in the optical time delay unit.

It is a further object of this invention to provide an optical signal processing system for a phased array antenna system that has low channel crosstalk and a high signal to noise ratio.

SUMMARY OF THE INVENTION

An optical signal processing system includes an input pixel array and an output pixel array, each of the arrays having corresponding predetermined patterns of pixels, and an optical time delay unit (OTDU) disposed to optically couple the input pixel array to the output pixel array. The OTDU couples the input and output pixel arrays so that a light beam passing through a selected one of the pixels in the input pixel array is directed to a corresponding pixel in the output pixel array along either a direct path or a delay path dependent on the linear polarization of the light beam emerging from the input pixel array. The OTDU includes an input polarizing beam splitter (PBS) coupled to receive light beams emanating from the input pixel array, a delay assembly, an imaging system for directing light beams from each of the pixels in the input pixel array to a corresponding one of the pixels in the output pixel array, and an output PBS coupled to receive light beams passing along either the delay path or the direct path and to pass these light beams to the output pixel array.

In one embodiment, the delay assembly comprises mirrors disposed along the delay path to deflect light beams emerging from the input PBS along the delay path so that the light beams pass along the selected distance of the delay path and are deflected into the output PBS at the appropriate angle for the beams to be directed by the PBS to the output pixel array. Alternatively, the delay assembly may comprise an array of optical fibers.

In accordance with this invention, the imaging system for directing light beams from a pixel in the input pixel array to a corresponding pixel in the output pixel array includes an imaging lens pair having a selected imaging ratio. Each imaging lens pair typically includes an entry spherical lens and an exit spherical lens; the focal length and positioning of the lenses in the delay assembly are selected to provide the imaging ratio for light beams passing from the input PBS to the output PBS. Typically one imaging lens pair is disposed so that light beams passing along the direct path pass therethrough, and one imaging lens pair is disposed along the delay path in which mirrors are used for deflecting the light beams. In the embodiment employing an optical fiber array in the delay path, one imaging lens pair is disposed to optically couple the input PBS to the optical fiber array and one imaging lens pair is disposed to optically couple the optical fiber array to the output PBS. In embodiments in which two channels having independently-controllable pixel arrays are used, each imaging lens pair advantageously further includes a first channel entry and exit spherical lens and a second channel entry and exit spherical lens.

Further, in accordance with this invention, a spatial filter is disposed in an imaging lens pair between the entry spherical lens and the exit spherical lens at the focal point of the entry spherical lens. Additionally, a high extinction polarizer is advantageously optically coupled to the input PBS, the output PBS, or both, so that the uniformly-polarized light beams passing along each of the delay path and the direct path pass through the high extinction polarizer, which further ensures only light of the selected polarization is passing along each respective path.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE PREFERRED EMBODIMENT

Figure 1:
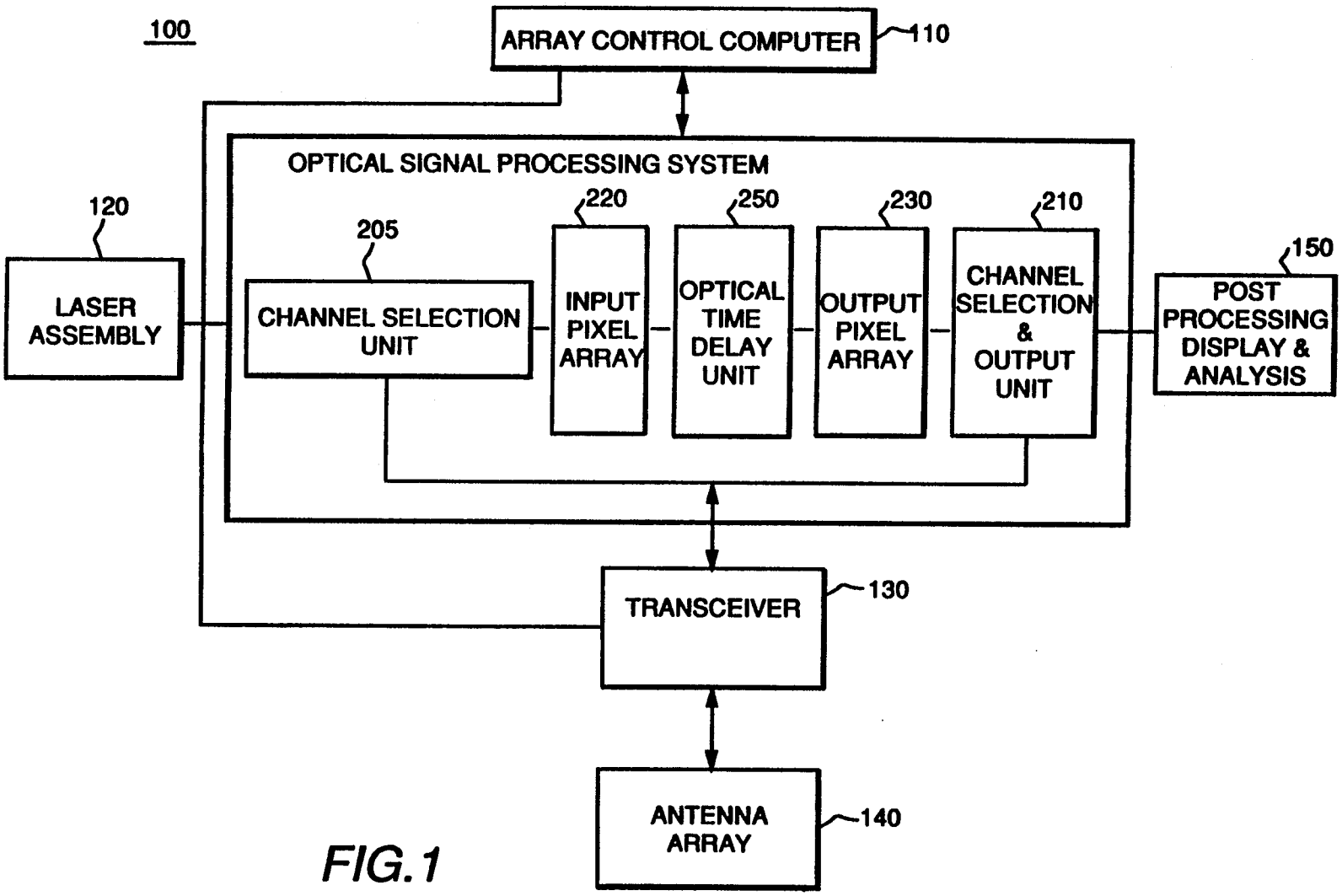
FIG. 1 is a block diagram of a phased-array antenna system comprising the present invention.

A phased-array antenna system 100 used as a radar or the like is illustrated in FIG. 1. Phased array antenna system 100 comprises an array control computer 110, a laser assembly 120, a transceiver 130 coupled to an antenna array 140, a post-processing display and analysis system 150, and an optical signal processing system 200. Array control computer 110 is coupled to the components listed above and generates signals to control and synchronize the operation, as described below, of those components so that antenna array 140 can operate in either a transmit or a receive mode with desired beamforming characteristics.

In particular, laser source 120 is optically coupled so that polarized light having a selected intensity and modulation passes into optical signal processing system 200. In the receive mode, return signals from antenna array 140 are also processed by signal processing system 200. Antenna system performance can be enhanced with a time-multiplexed arrangement described in copending application Ser. No. 07/826,501, filed Jan. 27, 1992 (RD-21,720), which is assigned to the assignee of the present invention and incorporated herein by reference. Light entering processing system 200 is passed through a channel selection unit 205 in which light beams are directed into a selected channel, typically by adjusting the polarization of the entering beams and passing them through a polarizing beam splitter (not shown in FIG. 1) that directs them into respective channel paths. As used herein, "polarizing beam splitter" (or "PBS") is used in the broadest sense to refer to a device which directs polarized light beams having different linear polarization orientations along different paths dependent on the polarization orientation. For example, a cube PBS is commonly used and is typically arranged so that linearly polarized light beams of a predetermined polarization will pass through the PBS undeflected and light beams of the opposite polarization orientation are deflected by about 90° unto a different path. Alternatively, a Thompson-prism beamsplitter can be used as a PBS.

Light passing from channel selection unit 205 sequentially enters a cascade of optical signal processing components comprising an input pixel array 220, an optical time delay unit 250, and an output pixel array 230. In the cascade configuration, these components are arranged so that there is a series of a pixel array, an optical time delay unit, a pixel array, another optical time delay unit, another pixel array, etc., with this sequence of components repeating as necessary to provide the desired optical signal processing capabilities of the system. The polarization orientation of each light beam is individually selected as it passes through each input pixel array 220, and that polarization determines whether the light beam is directed into the direct path or the delay path in each optical delay unit 250.

The successive optical delay units allow generation of differentially-time delayed optical signals for use in controlling the phased array antenna. For ease of discussion, only one group of these components is discussed herein (i.e., a sequence of one pixel array, an optical delay unit, the next successive pixel array); further, for ease of discussion, the respective pixel arrays are referred to as input and output arrays, although in the sequence of components the output pixel array of a first optical delay unit also serves as the input pixel array for the next subsequent optical delay unit. The final output pixel array in the cascade is optically coupled to a channel selection and output unit 210, from which the processed optical signals are directed to transceiver 130 in the transmit mode, or to post processing display and analysis system 150 in the receive mode.

Each input pixel array 220 typically comprises a spatial light modulator including nematic liquid crystals (NLCs) arranged in an array, but alternatively can comprise other types of optical processing devices, such as ferroelectric liquid crystals or the like. In a two channel device, each channel comprises independent processing capabilities for A×B collimated pairs of light beams so that at any given time in the operation of phased array antenna system 100, only one channel would be active (e.g., having light beams passed therethrough to be selectively delayed) while the inactive portions of the pixel arrays are being configured for the next processing evolution (e.g., to produce the optical signals to control the formation of the next beam to be transmitted). Each input pixel array 220 has two independently-controllable sets of A×B pixels (one for each channel) so that the pixel array comprises a total of 2A×B pixels that provide two independent channels for controlling A×B antenna elements or subarrays of antenna elements. For example, an antenna system that requires independent signals to control 1024 antenna elements requires an input pixel array having two channels of 32×32 elements, so that the two channel input pixel array comprises an array of 64×32 elements. such an array would typically have a size of about 16 mm×16 mm, assuming a relatively large 0.5 mm pixel pitch which is desirable for high interchannel isolation.

The pixels in each input pixel array 220 are arranged in a predetermined pattern. The pattern in which the pixels in each respective output array 230 (i.e., the next successive pixel array) are arranged corresponds to the respective input pixel array 220. To generate the optical control signal for each antenna element (or subassembly of elements), each respective light beam must pass from a respective pixel in input pixel array 220 through optical delay unit 250 and into a predetermined one of the pixel elements in output pixel array 230. In order for the respective light beams to pass from one predetermined pixel in the array to another predetermined pixel in the next pixel array in the cascade, it is important that light beams passing through optical delay unit 250 not be attenuated significantly nor undergo significant beam spreading.

Figure 2:
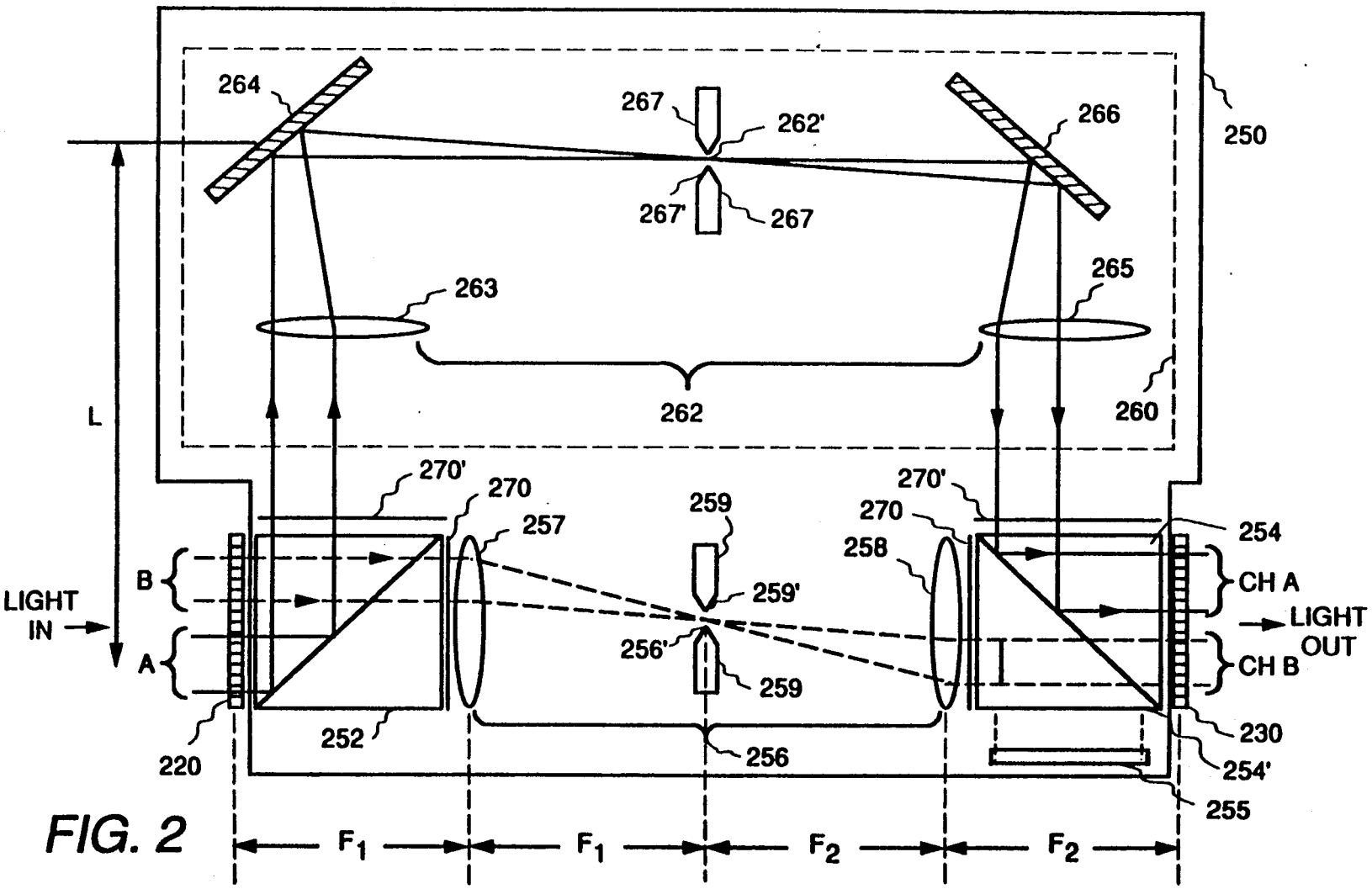
FIG. 2 is a part schematic representation and part block diagram of a free-space optical delay unit in accordance with this invention.

As illustrated in FIG. 2, optical time delay unit 250 is optically coupled to input pixel array 220 and to output pixel array 230. In accordance with this invention, optical time delay unit 250 comprises an input PBS 252, an output PBS 254, a delay assembly 260 (outlined in phantom in FIGS. 2 through 4), a direct path imaging apparatus 256 and a delay path imaging system 262. Input PBS 252 is disposed to receive light beams passing from input pixel array 220. FIG. 2 illustrates a two channel device, with two representative light beams defining the boundaries of the plurality of light beams comprising channel A shown in solid lines through the drawing and two similar representative light beams shown in dotted lines illustrating channel B. Light beams from either channel and individual light beams within each channel can traverse either the direct path between input PBS 252 and output PBS 254 (as shown by the dashed lines of channel B in FIG. 2) or the delay path (as shown by the solid lines of Channel A in FIG. 2) dependent on the polarization orientation of the light entering input PBS 252. The paths shown are only illustrative for the purposes of describing the invention.

Input PBS 220 is disposed so that light of a selected polarization, for example p-polarized light, passes directly through the PBS to direct path imaging apparatus 256 and thence to output PBS 254. Light of opposite linear polarization, in this example s-polarized light, is deflected in input PBS 252 so that it enters delay assembly 260. Delay assembly 260 comprises a mirror assembly having mirrors 264, 266 or similar apparatus for directing the light beams along a desired delay path so that the light emerging from input PBS 252 and emanating along the delay path traverses a longer distance to reach output PBS 254 than light emerging from input PBS 252 and emanating along the direct path to output PBS 254.

Figure 3:
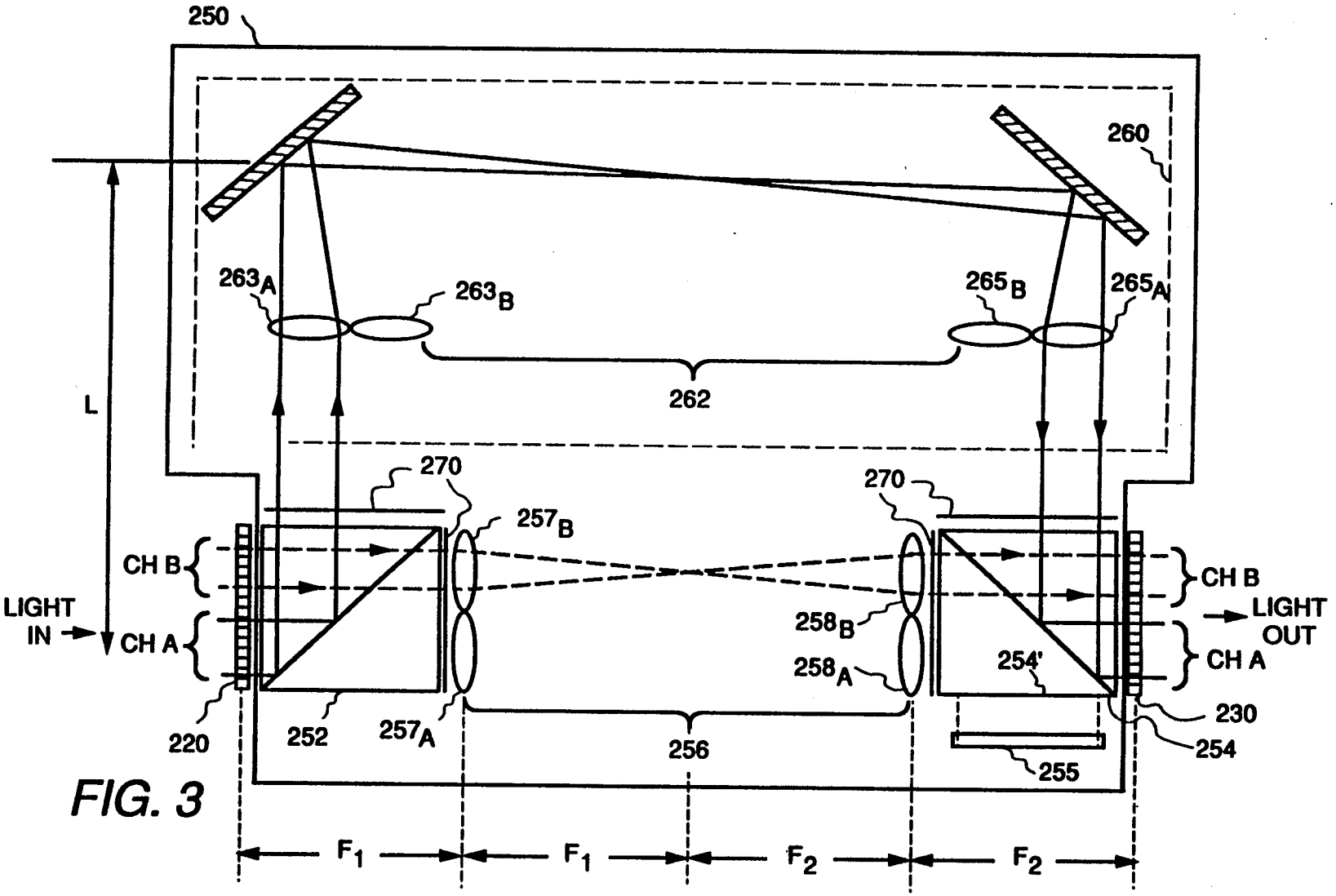
FIG. 3 is a part schematic representation and part block diagram of a free-space optical delay unit in accordance with another embodiment of this invention.

Mirror 264 is disposed at a distance L (as illustrated in FIG. 2, shown with respect to the center of channel A) from input PBS 252; mirror 266 is similarly disposed at a distance L from output PBS 254 so that light beams passing along this delay path traverse a distance 2L longer than the distance traversed by the light in the direct path. The differential time delay between light beams passing along the delay path and the direct path is 2L/c, in which c is the free-space speed of light. Thus, the amount of time delay that can be imparted by any given optical time delay unit 250 in the optical architecture of signal processing system 200 can be determined by selecting the distance L in each optical time delay unit 250. Further, mirrors 264, 266 are disposed so that light beams emerging from input PBS 252 are deflected to enter output PBS 254 at an angle to allow the beams to be deflected to output pixel array 230. For example, when a cube type PBS as illustrated in FIGS. 2 and 3 is used in the OTDU, the mirrors deflect the light by a total of about 180° to enter output PBS 254 at substantially a reciprocal direction to the light beams passing along the delay path from input PBS 252.

In accordance with this invention, direct path imaging apparatus 256 and delay path imaging system 262 are disposed in optical time delay unit 250. Direct path imaging apparatus 256 and delay path imaging system each comprise at least one imaging lens pair (discussed below) having a selected imaging ratio disposed across the respective light paths between input PBS 252 and output PBS 254. As used herein, reference to an imaging system or apparatus being "disposed across" a path (e.g., the direct path or the delay path) refers to the imaging system being disposed along or in the path so that light beams emanating along that path pass through the imaging system or apparatus.

Direct path imaging apparatus 256 comprises an imaging lens pair including an entry spherical lens 257 and an exit spherical lens 258. Entry spherical lens 257 is optically coupled to input PBS to receive light beams passing therethrough onto the direct path to output PBS 254. Lens 257 is further disposed at its focal length distance $F_1$ (measured along the path light beams over which the light beams emanate) from input pixel array 220. Exit spherical lens 258 is disposed to receive light beams emanating from entry spherical lens 257 and is optically coupled to output PBS 254. Exit spherical lens is further disposed at its focal length distance F2 (measured along the path light beams over which the light beams emanate) from output pixel array 230. Light beams emanating from exit lens 258 are collimated and emanate along paths that cause respective ones of the light beams to pass into respective pixels in output pixel array 230 that correspond to the pixels in input pixel array 220 through which each of the respective light beams passed.

Each imaging lens pair has a selected imaging ratio, that is, the relative size of the input and output images measured at the focal plane at input pixel array 220 and at the focal plane on output pixel array 230, respectively. The imaging ratio is advantageously 1:1, so that the various pixel arrays in the optical signal processing system are the same size, allowing for easier fabrication of the individual arrays and the signal processing system. As used herein, "1:1 imaging" refers to an optical system that focuses an image from one focal plane to a second focal plane so that the image in the second focal plane is of the same dimensions as the first focal plane. The image on the second focal plane may, however, be inverted with respect to the image on the first focal plane.

Such a 1:1 imaging system is illustrated in FIG. 2, in which the focal length distances F1 and F2 of entry spherical lens 257 and exit spherical lens 258 are the same. Representative light beams in Channel B, shown as dotted lines passing along the direct path between input PBS 252 and output PBS 254, cross at a focal point 256' of entry lens 257 located between the lenses.

A spatial light filter 259 having an aperture 259' is advantageously disposed in the direct path at focal point 256' such that aperture 259' is situated where the light beams cross, that is where the spatial extent of the plurality of light beams emanating from entry lens 257 is smallest. The size of aperture 259' is selected to correspond to this smallest spatial extent of the beams, and the remainder of spatial filter 259 comprises an optically opaque material such that light beams that have spread or been deflected as they pass from input pixel array 220 and input PBS 252, and thus are not passing along the desired direct path, are absorbed. In this fashion the signal to noise ratio of the optical signal processing system is enhanced by limiting the mixing of light beams traveling along desired paths in the optical architecture with light beams that have been deflected from such a desired path.

Delay path imaging system 262 comprises at least one imaging lens pair having a selected imaging ration disposed in the delay path. As illustrated in FIG. 2, imaging system 262 advantageously has an imaging ratio of 1:1 (for similar reasons as noted above with respect to the direct path imaging apparatus) and comprises an entry spherical lens 263 and an exit spherical lens 265. Lens 263 has a focal length such that light beams passing therethrough are focussed at a delay path focal point 262'; in the 1:1 imaging system, entry spherical lens 263 is disposed at one focal-length's distance from input pixel array 220 (measured along the path travelled by the light beams deflected in input PBS); light passing from entry lens 263 is deflected 90° by mirror 264 toward mirror 266, where the light beams are again deflected 90° towards exit lens 265 and output PBS 254. Light beams emerging from exit lens 265 are collimated such that when they enter output PBS 254 and, due to their polarization, are deflected 90° so that they are again emanating in t same direction as when they entered input PBS 252, and they are aligned to enter respective pixels corresponding to the pixels through which they passed in input pixel array 220.

A spatial light filter 267 having an aperture 267' is advantageously disposed in the delay path at focal point 262'. Aperture 267' is positioned at the point where the plurality of light beams emerging from entry lens 263 cross, that is where the spatial extent of the plurality of light beams is smallest. The size of aperture 267' is selected to correspond to this smallest spatial extent of the beams, and the remainder of spatial filter 267 comprises an optically opaque material such that light beams that have spread or been deflected as they pass from input pixel array 220 and input PBS 252, and thus are not passing along the desired delay path, are absorbed. Thus, similar to spatial light filter 259 in the direct path, spatial light filter 267 improves the signal to noise ratio of the optical signal processing system.

A high extinction polarizer 270 is advantageously optically coupled to input PBS 252 and output PBS 254 in the direct path and a high extinction polarizer 270' is advantageously placed in the delay path. High extinction polarizers 270 and 270' are similar except that they are arranged to pass different polarization orientations of light (i.e., one passes s-polarized and one passes p-polarized light beams). Each polarizer 270 and 270' is advantageously a sheet polarizer comprising a material that has relatively high extinction ratio, for example about 4000:1 or more, such that only light of a predetermined linear polarization is allowed to pass through the polarizer. One example of a commercially available polarizer having an extinction ratio of about 10,000:1 is Polarcor, a polarizer produced by the Corning Company. High extinction polarizers 270, 270' are disposed respectively in the direct path and the delay path (each of which nominally have light beams of only one polarization passing therealong) in order to remove extraneous light beams of the incorrect polarization that may have been deflected onto such paths. One high extinction polarizer 270 is preferably disposed between input PBS 252 and direct path entry spherical lens 257 and one disposed between output PBS 254 and direct path exit spherical lens 258. Similarly, one high extinction polarizer 270' is advantageously disposed between input PBS 252 and entry spherical lens 263, and one positioned between delay path exit spherical lens 265 and output PBS 254. Typical commercially-available cube PBS's have extinction ratios of 1000:1 or better. As switching in the time delay unit is determined by the linear polarization of the respective light beams, it is desirable to ensure that only light beams of the desired polarity are deflected onto the respective direct and delay paths. The placement of high extinction polarizers in the direct path and delay path ensures a high degree of polarization uniformity in the light signals in the respective paths and thus improves the system signal-to-noise ratio.

Output PBS 254 comprises a noise port 254' which is coupled to an output noise absorber 255. "Noise" light beams, such as light beams of an improper polarization for the channel (e.g., s-polarized light in the direct path and p-polarized light in the delay path for the example arrangement discussed above) enters output PBS 254 and is deflected through noise port 254' into noise absorber 255. Noise absorber 255 typically comprises a light-absorbing dark material such as paper or the like. This noise port structure enables light beams that cause noise in signal processing system 200 to be removed from the signal path altogether, thus further enhancing the quality of the signal and the signal to noise ratio of the system.

In operation, light beams emanating from laser assembly 120 (FIG. 1) or from another optical delay unit in the optical architecture of optical signal processing system 200 enter input pixel array 220 (FIG. 2). The operation of the present invention is equally applicable to a signal processing system having only one channel of light beams or a plurality of channels; thus the operation of only one channel is described here. In a signal processing system comprising multiple channels, other components in optical processing system 200 are used to switch between channel A and channel B to effect time multiplexed operation. Each light beam entering input pixel array 220 is of a known linear polarization (either by reason of emanating from a known laser source or passing from a preceding optical time delay unit in which the polarization of known selected light beams was changed to effect the time delay) and enters a respective pixel in the array. Typically each pixel comprises a nematic liquid crystal (either twisted or parallel-rub birefringent mode liquid crystals can be used). Dependent on the control signals applied to each respective pixel in the array, the linearly polarized light will pass through each pixel with its polarization either unchanged or shifted by 90°.

The light beams are then incident on input PBS 252, and, dependent on the selected polarization for each light beam, are either passed directly through the PBS to direct path imaging apparatus 256 or deflected into delay assembly 260. For example, p-polarized light beams may pass directly through input PBS 252 while s-polarized light is deflected into delay assembly 260. The light emanating from input PBS 252 passes through high extinction polarizer 270 to substantially ensure that only p-polarized light beams pass along the direct path. Light beams entering direct path imaging apparatus 256 that pass through spatial light filter 259 are focused into tightly collimated beams aligned to enter the corresponding pixels in output pixel array 230. The light beams pass from direct path imaging apparatus 256 through another high extinction polarizer 270 and into output PBS 254, where, due to the p-polarization, they pass directly through to output pixel array 230.

Light beams (s-polarized in accordance with the examples used herein) deflected into the delay assembly pass through high extinction polarizer 270' and into delay path imaging system 262. Light emerging from entry spherical lens 263 is deflected by mirror 264, through spatial light filter 267, and is then deflected further by mirror 266 into output spherical lens 265. Collimated light beams aligned to enter respective ones of the pixels in output pixel array 230 emerge from exit spherical lens 265, pass through high extinction polarizer 270' and enter output PBS 254, in which, due to their polarization, they are deflected by 90° into output pixel array 230. Light beams passing from output pixel array 230 either pass into the next subsequent optical time delay unit (not shown) or into channel selection and output unit 210 (FIG. 1).

An alternative embodiment of the present invention is illustrated in FIG. 3. Optical time delay unit 250 is similar in all respects to the time delay unit described above with respect to FIG. 2 except that direct path imaging apparatus 256 and delay path imaging system 262 comprise separate entry and exit spherical lenses for each channel. Thus direct path imaging apparatus 256 comprises a channel A entry spherical lens $\mathbf{257}_A$ and a Channel B entry spherical lens $\mathbf{257}_B$, and a Channel A exit spherical lens $\mathbf{258}_A$ and a Channel B exit spherical lens $\mathbf{258}_B$. Similarly, delay path imaging system comprises a Channel A entry spherical lens $\mathbf{263}_A$ and a Channel B entry spherical lens $\mathbf{263}_B$, and a Channel A exit spherical lens $\mathbf{265}_A$ and a Channel B exit spherical lens $\mathbf{265}_B$. Provision of a separate entry and exit lens for each channel enhances the focussing of light beams onto the respective pixels in output pixel array 254. The operation of the optical time delay illustrated is otherwise the same as described for FIG. 2 above.

Figure 4:
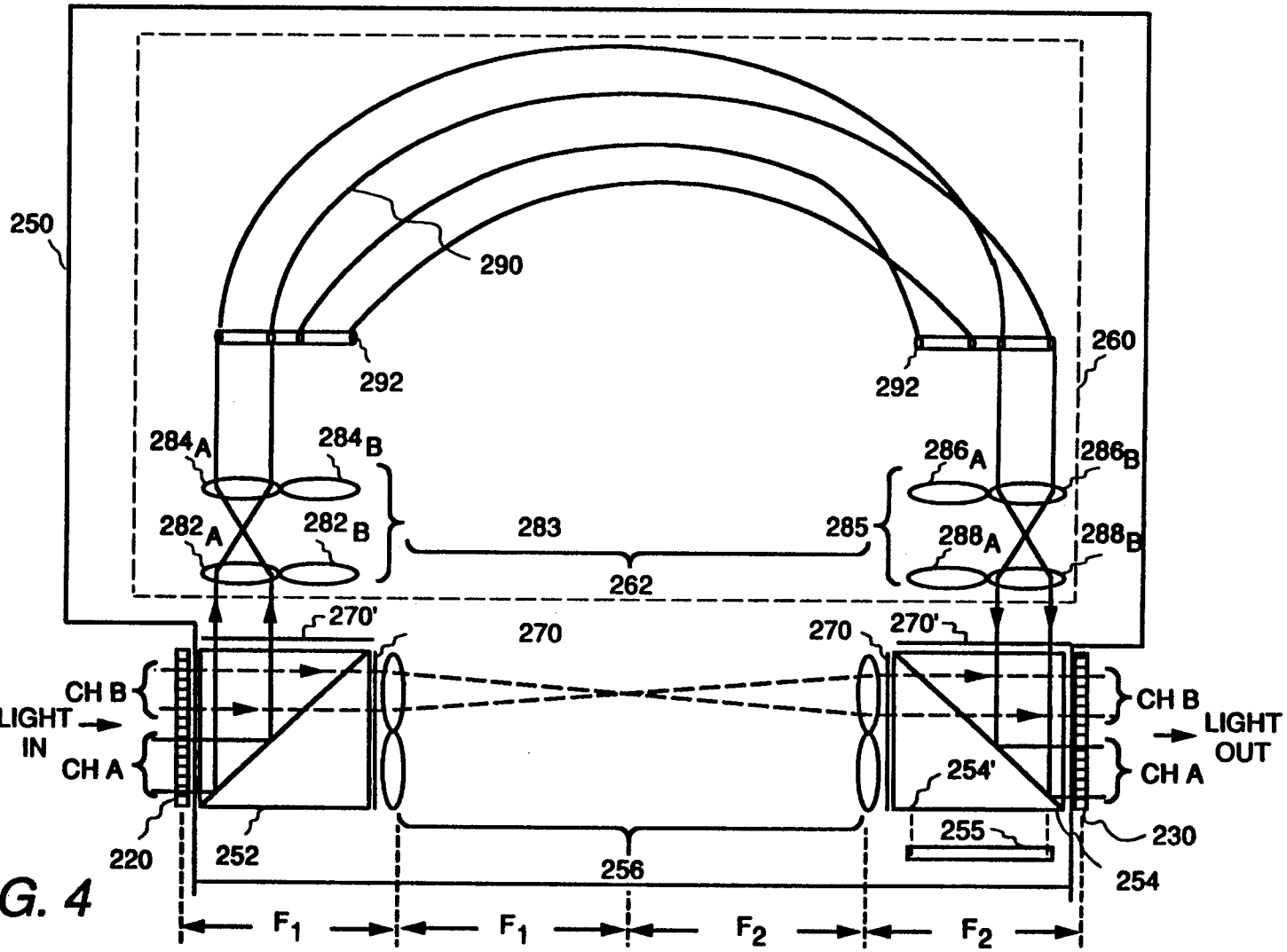
FIG. 4 is a part schematic representation and part block diagram of an optical fiber-based optical delay unit in accordance with a further embodiment of this invention.

Alternatively, as illustrated in FIG. 4, optical time delay unit 250 may comprise an optical fiber array 290 in the delay path to provide for longer time delays than are practical with free-space delay assemblies as described above with respect to FIGS. 2 and 3. Optical time delay unit 250 illustrated in FIG. 4 is similar in all respects to the time delay unit described above with respect to FIG. 3 except for delay assembly 260. Delay assembly 260 comprises delay path imaging system 262, optical fiber array 290, and an input lenslet array 292 and an output lenslet array 294 disposed at respective ends of optical fiber array 290. Optical fiber array 290 comprises a plurality of polarization maintaining (PM) fibers having a selected length. The flexibility of PM fibers allows for relatively long lengths (which provide the ability to induce long differential time delays in the optical signals) to be coiled in relatively compact optical time delay units 250. Lenslet arrays 292 and 294 preferably comprise graded index (GRIN) or self-focussing (SELFOC) lenses. Alternatively, lenslet array sheets produced by holographic techniques or by binary optics can also be used Delay path imaging system 262 comprises an input imaging apparatus 283 and an output path imaging apparatus 285. Input imaging apparatus 283 is disposed to receive light beams emanating from input PBS 252 through high extinction polarizer 270' so that respective ones of the light beams are focussed on selected lenses in lenslet array 292 and hence into corresponding ones of the optical fibers in array 290. Input imaging apparatus 283 comprises entry spherical lenses $\mathbf{282}_A$ and $\mathbf{282}_B$ and exit spherical lenses $\mathbf{284}_A$ and $\mathbf{284}_B$, the subscripts indicating the lenses disposed in the paths of light beams from channels A and B respectively. Similarly, output imaging apparatus 285 comprises entry spherical lenses $\mathbf{286}_A$ and $\mathbf{286}_B$ and exit spherical lenses $\mathbf{288}_A$ and $\mathbf{288}_B$, the subscripts indicating the lenses disposed in the paths of light beams from channels A and B respectively.

Input imaging apparatus 283 has an imaging ratio selected to provide efficient and effective optical coupling of light beams between input PBS 252 and optical fiber array 290. The imaging ratio may be 1:1 or involve demagnification, based upon the pattern of pixels in input pixel array 220 and the pattern of optical fibers in array 290. In optical time delay units having only single lenses in input imaging apparatus 283 (i.e., one lens for both channels), the imaging apparatus can also be arranged to magnify as well as demagnify the image onto lenslet array 292. Output imaging apparatus 285 typically has an imaging ratio that inversely corresponds to the imaging ratio of input imaging apparatus 283. Thus, if input imaging apparatus 283 has an imaging ratio of 2:1 (i.e., demagnifies the light beam pattern emanating from input PBS 252), then output imaging apparatus 285 has an imaging ratio of 1:2 (assuming, as would commonly be the case, that input pixel array 220 and output pixel array 230 are of the same size).

The arrangements of this invention thus allow for an optical time delay unit that has low channel cross-talk and relatively high signal to noise ratios.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An optical signal processing system comprising:

an input pixel array having a predetermined input array pattern;

an output pixel array having a predetermined output array pattern, said output array pattern corresponding to said input array pattern; and an optical time delay unit disposed to optically couple said input pixel array to said output pixel array so that light beams passing from predetermined ones of the pixels in said input pixel array will enter corresponding ones of the pixels in said output pixel array, whereby each of said light beams will pass along a respective delay path or a respective direct path in said optical time delay unit dependent on the polarization of the light beam;

said optical time delay unit comprising an input polarizing beam splitter (PBS), an output PBS, a delay assembly, and an imaging system comprising at least one imaging lens pair having a respective selected imaging ratio and that is adapted to direct light beams from each respective one of the pixels in said input pixel array to a corresponding one of the pixels in said output pixel array.

2. The system of claim 1 wherein said imaging system comprises at least one imaging lens pair having a selected first imaging ratio disposed across said delay path and at least a second imaging lens pair having a selected second imaging ratio disposed across said direct path.

3. The system of claim 2 wherein each of said imaging lens pairs comprises an entry spherical lens and an exit spherical lens.

4. The system of claim 3 wherein said first imaging ratio and said second imaging ratio are the same.

5. The system of claim 4 wherein said first and second imaging ratio is 1:1.

6. The system of claim 3 wherein said input pixel array and said output pixel array each comprise at least two independently controllable patterns of pixels arranged to pass at least a first and a second channel of light beams, each of said channels comprising a corresponding plurality of light beams.

7. The system of claim 6 wherein each of said imaging lens pairs further comprises a first channel entry spherical lens, a second channel entry spherical lens, a first channel exit spherical lens, and a second channel exit spherical lens, said lenses being disposed such that respective pairs of said first channel entry and exit lenses are disposed across the first channel delay path and first channel direct path, and respective pairs of said second channel entry and exit lenses are disposed across the second channel direct path and the second channel delay path.

8. The system of claim 3 wherein said delay assembly comprises a mirror assembly disposed along said delay path, said mirror assembly being disposed in a spaced relationship with said entry spherical lens and said exit spherical lens such that light passing from said entry lens will be deflected to enter to said exit lens.

9. The system of claim 8 wherein said mirror assembly is disposed in said optical time delay unit such that the distance of the path travelled by light passing from said entry lens to said exit lens is twice the focal length of said entry lens, said entry lens and said exit lens having the same focal length.

10. The system of claim 9 further comprising a direct path spatial filter disposed at the focal point between said entry spherical lens and said exit spherical lens in said direct path.

11. The system of claim 10 further comprising a delay path spatial filter disposed between said entry spherical lens and said exit spherical lens along said delay path at a position corresponding to the focal length of said entry spherical lens.

12. The system of claim 11 wherein said direct path spatial filter and said delayed path spatial filter each comprise an optically opaque material having an aperture disposed at the focal point of said entry spherical lens.

13. The system of claim 1 wherein said delay assembly comprises an array of optical fibers having a selected length, said optical fiber array being optically coupled via said imaging means to said input PBS and said output PBS to form said delay path.

14. The system of claim 13 wherein said imaging means for directing light beams comprises a delay path imaging system and a direct path imaging apparatus.

15. The system of claim 14 wherein said delay path imaging system comprises an input imaging apparatus having a selected imaging ratio and disposed to optically couple said input PBS to the optical fiber array and an exit imaging apparatus disposed to optically couple said optical fiber array to said output PBS.

16. The system of claim 15 wherein said input pixel array and said output pixel array each comprise at least two independently controllable patterns of pixels arranged to pass at least a first and a second channel of light beams.

17. The system of claim 14 wherein each of said input and output imaging systems comprises a first and a second entry spherical lens and a first and a second exit spherical lens, said lenses being disposed such that respective ones of the first entry and exit lenses and the second entry and exit lenses are respectively disposed across the first channel delayed path and the second channel delayed paths.

18. The system of claim 17 further comprising a direct path imaging system having a selected imaging ratio coupling said input and output PBS's.

19. The system of claim 18 further comprising a spatial filter disposed in each of said imaging systems at the respective focal points of each of said respective entry lenses.

20. The system of claim 18 wherein said input pixel array and said output pixel array each comprise liquid crystal pixels.

21. The system of claim 1 further comprising an optical noise absorber and said output PBS further comprises a noise port, said optical noise absorber being optically coupled to said noise port.

22. An optical signal processing system comprising:

an input pixel array having a predetermined input array pattern;

an output pixel array having a predetermined output array pattern, said output array pattern corresponding to said input array pattern; and an optical time delay unit disposed to optically couple said input pixel array to said output pixel array so that light beams passing from predetermined ones of the pixels in said input pixel array will enter corresponding ones of the pixels in said output pixel array, whereby each of said light beams will pass along a respective delay path or a respective direct path in said optical time delay unit dependent on the polarization of the light beam;

said optical time delay unit comprising an input polarizing beam splitter (PBS), an output PBS, a delay assembly, and at least one high extinction ratio polarizer, said input PBS being optically coupled to said delay assembly and said output PBS such that entering light beams having a predetermined linear polarization will be deflected into said delay assembly and such that entering light beams having the opposite linear polarization will be deflected along said direct path, said at least one high extinction polarizer being optically coupled to at least one of said polarizing beam splitters.

23. The system of claim 22 wherein said at least one high extinction polarizer is optically coupled to said input PBS to receive light beams passing therefrom along said delay path.

24. The system of claim 22 wherein said at least one high extinction polarizer is optically coupled to said input PBS to receive light beams passing therefrom along said direct path.

25. The system of claim 22 further comprising a plurality of high extinction polarizers, a respective one of said high extinction polarizers being coupled to said input PBS to receive light beams passing therefrom along each of said delay and direct paths.

26. The system of claim 22 wherein said at least one high extinction polarizer is optically coupled to said output PBS to receive light beams directed thereto along said delay path.

27. The system of claim 22 wherein said at least one high extinction polarizer is optically coupled to said output PBS to receive light beams directed thereto along said direct path.

28. The system of claim 22 further comprising a plurality of high extinction polarizers, a respective one of said high extinction polarizers being coupled to said output PBS to receive light beams directed thereto along each of said delay and direct paths.

29. The system of claim 22 further comprising a plurality of high extinction polarizers, a respective one of said polarizers being optically coupled to each of said input and output PBS's.

30. The system of claim 22 wherein each of said high extinction polarizers comprises a sheet polarizer.

31. A phased array antenna system comprising:

a plurality of antenna elements arranged in an array;

an optical signal processing system coupled to the antenna array and having an optical architecture adapted to generate differentially time-delayed optical signals to control antenna array radiation patterns; and an optoelectronic transceiver array coupled to said optical signal processing system and said antenna array to convert optical signals passing to said antenna array into electrical signals and to convert electrical signals passing from said antenna array into optical signals;

said optical signal processing system comprising:

a plurality of pixel arrays, each having a predetermined array pattern;

a plurality of optical time delay units, each of said units being disposed between respective ones of said pixel arrays to optically couple respective ones of said pixel arrays so that light beams passing from predetermined ones of the pixels in one input array will enter corresponding ones of the pixels in the next successive pixel array, whereby each of said light beams will pass along a respective delay path or a respective direct path in beams will pass along a respective delay path or a respective direct path in said optical time delay unit dependent on the polarization of the light beam;

each of said optical time delay units comprising an input polarizing beam splitter (PBS), an output PBS, a delay assembly, and an imaging system comprising at least one imaging lens pair having a respective selected imaging ratio and that is adapted to direct light beams from each respective one of the pixels in one pixel array to a corresponding one of the pixels in the next successive pixel array in said optical architecture.

32. The system of claim 31 wherein said imaging system for directing light beams in each of said optical time delay units comprises at least one imaging lens pair having a selected imaging ratio disposed in said delay path and a second imaging lens pair having a selected imaging ratio disposed in said direct path.

33. The system of claim 32 wherein each of said imaging lens pairs comprises an entry spherical lens and an exit spherical lens.

34. The system of claim 33 wherein at least one of said delay assemblies comprises a plurality of mirrors disposed in said delay path, said mirrors being disposed in a spaced relationship with said entry spherical lens and said exit spherical lens such that light passing from said entry lens will be deflected by said mirrors to enter said exit spherical lens.

35. The system of claim 33 further comprising at least one spatial filter disposed between said entry spherical lens and said exit spherical lens in at least one of said imaging lens pairs at the focal point of the respective entry spherical lens.

36. The system of claim 33 wherein at least one of said delay assemblies comprises an array of optical fibers having a selected length, the optical fiber array being optically coupled via said imaging means to said input PBS and to said output PBS to form said delay path.

37. The system of claim 36 wherein said imaging means for directing light beams comprises a delay path imaging system and a direct path imaging apparatus.

38. The system of claim 37 wherein said delay path imaging system comprises an input imaging apparatus disposed to optically couple said input PBS to said optical fiber array and an exit imaging apparatus disposed to optically couple said optical fiber array to said output PBS.

39. The system of claim 38 further comprising at least one spatial filter disposed between said entry spherical lens and said exit spherical lens in at least one of said imaging lens pairs at the focal point of the respective entry spherical lens.

40. The system of claim 38 further comprising at least one high extinction ratio polarizer optically coupled to one of said polarizing beam splitters in each of said optical time delay units.

41. The system of claim 40 wherein at least one of said high extinction polarizers is disposed in each delay path, respectively and at least one of said high extinction polarizers is disposed in each direct path, respectively.

42. The system of claim 38 further comprising a plurality of high extinction polarizers, one of said high extinction polarizers being optically coupled to receive light beams passing from said input PBS along said delay path and another one of said high extinction polarizers being optically coupled to receive light beams passing from input PBS along said direct path.

43. The system of claim 42 further comprising an additional high extinction polarizer optically coupled to said output PBS to receive light beams directed to said output PBS along said delay path, and a further high extinction polarizer optically coupled to said output PBS to receive light beams directed to said output PBS along said direct path.

* * * * *